United States Patent [19]

Irwin

[11] 4,351,242

[45] Sep. 28, 1982

[54] RAILWAY CAR TRUCK SIDE FRAME

[75] Inventor: Howard D. Irwin, Wilmington, Del.

[73] Assignee: E. I. Du Pont de Nemours and Company, Wilmington, Del.

[21] Appl. No.: 122,726

[22] Filed: Feb. 19, 1980

[51] Int. Cl.[3] ..... B61F 5/00

[52] U.S. Cl. ..... 105/206 A

[58] Field of Search ..... 105/182 R, 197 R, 198, 105/199 R, 199 S, 206 R, 206 A, 224.1, 199.1 B, 200, 202

[56] References Cited

U.S. PATENT DOCUMENTS

| | | | |
|---|---|---|---|
| 1,597,947 | 8/1926 | Anderson | 105/206 A |
| 1,620,498 | 3/1926 | Symington | 105/206 A |
| 2,090,498 | 8/1937 | Griffin | 105/206 R |
| 2,295,936 | 9/1942 | Gottrell | 105/206 R |
| 2,620,744 | 12/1952 | Gray et al. | 105/206 A |

*Primary Examiner*—Richard A. Bertsch

[57] ABSTRACT

A railway car truck side frame is formed of compression and tension members and double shear webs joined together by welding so as to form a box-beam wherein the welds joining the main structural units are so disposed as to be stressed in shear rather than tension or compression to provide for optimum fatigue performance.

1 Claim, 6 Drawing Figures

RAILWAY CAR TRUCK SIDE FRAME

BACKGROUND OF THE INVENTION

This invention relates to side frames for railway car trucks, and more particularly to side frames of structural steel elements welded together.

Side frames now in general use have been produced as cast structures. Flaws of the type sometimes present in these castings are difficult to detect by any means of inspection and can lead to fatigue failures and total loss of structural integrity which could result in derailment or other serious consequences. Welded type side frames are known. However there has not been made available to railway car manufacturers welded structural steel side frames with sufficient resistance to metal fatigue to be capable of withstanding the rigorous conditions of normal operation of such equipment. Railway car manufacturers have been seeking a side frame construction that will withstand fatigue loads indefinitely as a replacement for worn and cracked cast side frames. This invention fulfills that need.

SUMMARY OF THE INVENTION

A railway car truck side frame comprising: a compression member horizontally extending the length of the side frame; a tension member substantially coextensive with said compression member and spaced therefrom, said tension member having an intermediate horizontal portion merging at opposite ends into diagonally and upwardly and outwardly extending portions; a rectangular bolster frame mounted between said members coextensive with said intermediate horizontal portion of said tension member; and spaced apart shear webs welded between said compression member, said diagonally and upwardly and outwardly portions of said tension member and said bolster frame to form a box-beam as the primary structural unit for the side frame, said shear webs having aligned openings therethrough; a flange attached to the periphery of said openings and joining said side plates; coextensive reinforcing members welded to the box along the diagonally and upwardly and outwardly extending portions of said tension member and the side plates; and separate stiffeners welded in a longitudinal array to the intermediate horizontal portion of the tension member.

DETAILED DESCRIPTION OF THE PREFERRED EMBODIMENT

Figure 1:
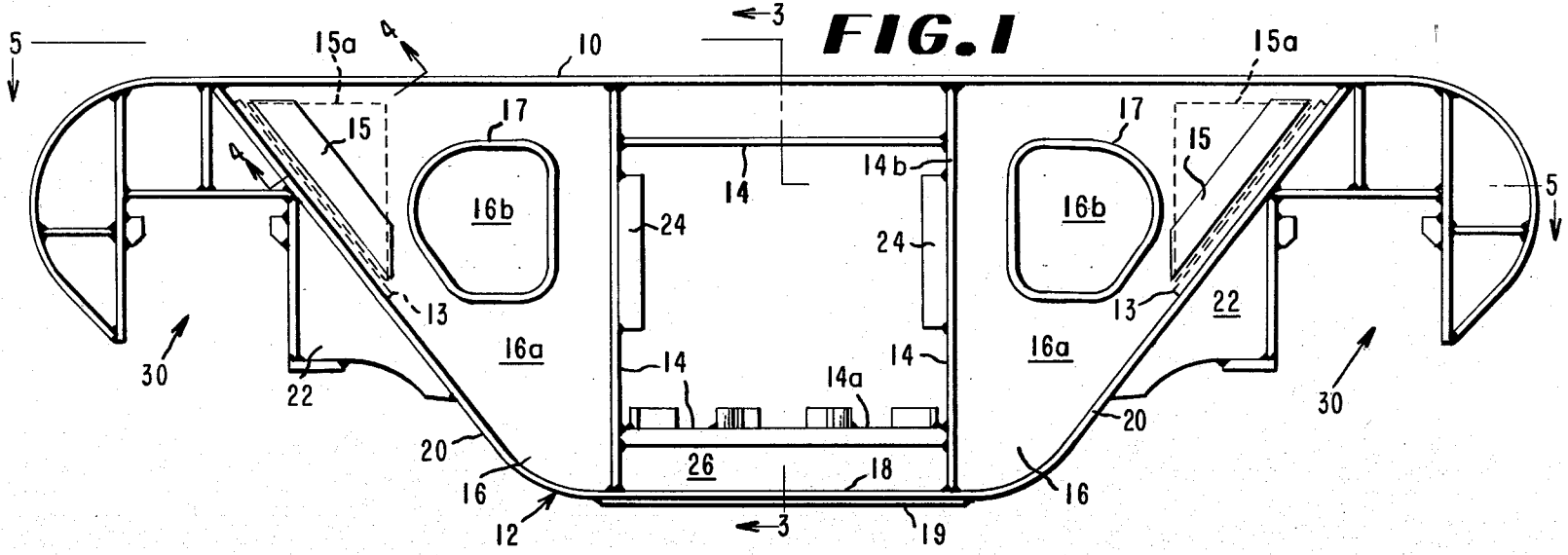
FIG. 1 is a side elevation view of the side frame of this invention.
Figure 2:
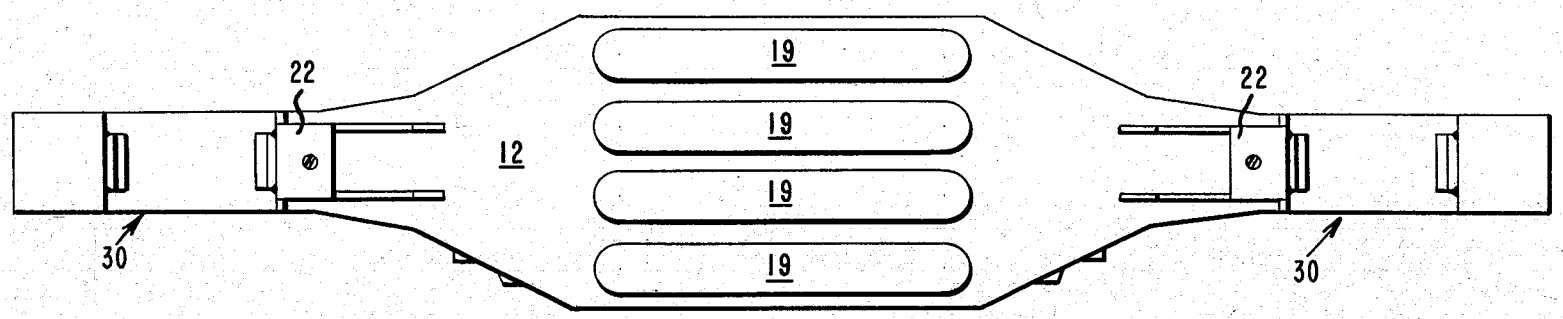
FIG. 2 is the bottom plan view of the side frame of this invention.
Figure 6:
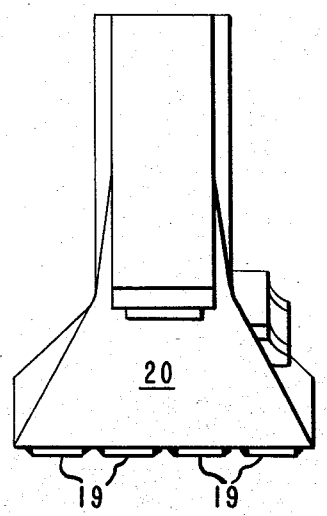
FIG. 6 is an end view of the side frame of FIG. 1.

Referring to the drawing the side frame of this invention generally includes a horizontally disposed compression member 10 extending the full length of the frame and radiused at its ends, a tension member 12, a bolster frame 14 and a reinforced box 16 located on either side of frame 14 between the tension and compression members. The tension member includes an intermediate portion 18 extending substantially horizontally, the opposite ends of which merge into a pair of diagonally and upwardly and outwardly portions 20 which terminate in and are welded to compression member 10. The bolster frame 14 is of rectangular form and generally coextensive with the horizontal intermediate portion 18 of the tension member. The upright portions **14*b* of the bolster frame 14 are welded between the tension and compression members. Welded to inner surfaces of the upright portions of the bolster frame are bolster guide lugs 24 of generally U-shaped cross section. The lower horizontal portion 14*a* of the bolster frame is a spring seal welded to the upright portions. The spring seat is reinforced in its connection to the side frame by gussets 26 welded to the underside of the seat and to the tension member 12. The reinforced box 16 is formed of ends comprising compression member 10, the diagonal portion 20 of the tension member 12 and the upright portions 14*b* of bolster frame 14 are welded to side plates or shear webs 16*a* which are provided with aligned openings 16*b*. A flange 17 is welded to the periphery of the openings in side plates 16*a* to join the plates at this location adding stiffness to the box. In addition reinforcing members 15, 15*a* are welded to side plates 16*a* and reinforcing member 13 is welded to diagonal portion 20 of the tension member 12 coextensive with the reinforcing members 15, 15*a*. Finally 4 separate stiffeners 19 arranged in a longitudinal parallel array are welded to the bottom of the intermediate portion 18** of the tension member.

Figure 4:
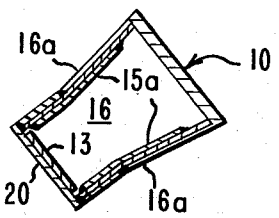
FIG. 4 is a section view taken along line 4—4 of FIG. 1.
Figure 5:
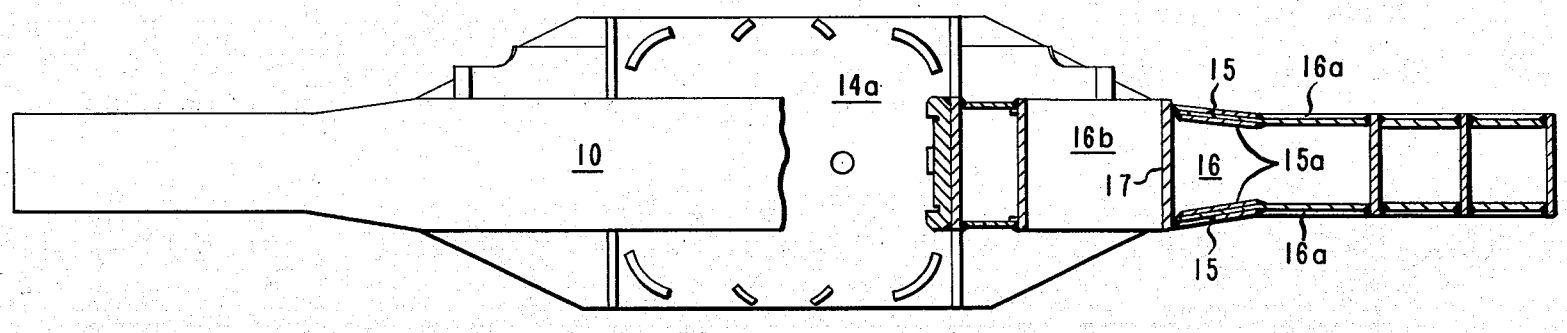
FIG. 5 is a section view of FIG. 1 taken along line 5—5.
Figure 3:
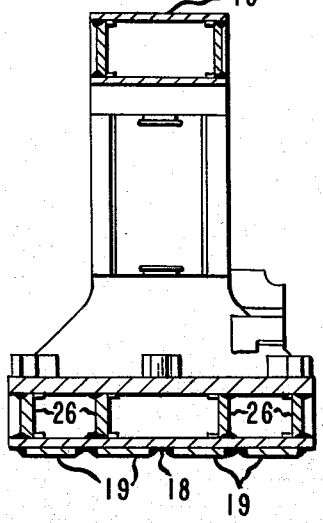
FIG. 3 is a vertical section view taken aong line 3—3 of FIG. 1.

Stiffeners **15, 15*a*, 13 and 19 are located at critical stress points of the side frame. The stiffeners 19 must be separate pieces rather than a single plate to avoid stress concentration on too few welds and furthermore to avoid lack of stiffness in too wide a plate. As can readily be seen from FIGS. 4 and 5** primary structural unit of this side frame is a reinforced box-beam.

Disposed at opposite ends of the side frame are journal boxes indicated generally at 30 which are formed from a continuation of the compression member along with structural members 22 attached to the tension member.

The fabricated side frame described herein obtains the required resistance to fatigue loading by eliminating welds in the main structural members and having no butt welds at critical load points. Welds joining the main structural elements, e.g., tension member 12, compression member 10 and shear webs **16*a*** are so disposed to be stressed in shear rather than tension or compression.

I claim:

1. A railway car truck side frame comprising: a compression member horizontally extending the length of the side frame; a tension member substantially coextensive with said compression member and spaced therefrom, said tension member having an intermediate horizontal portion merging at opposite ends into diagonally and upwardly and outwardly extending portions; a rectangular bolster frame mounted between said members coextensive with said intermediate horizontal portion of said tension member; spaced apart shear webs welded between said compression member, said diagonally and upwardly and outwardly portions of said tension member and said bolster frame to form a box-beam as the primary structural unit for the side frame, said shear webs having aligned openings therethrough;

a flange attached to the periphery of said openings and joining said shear webs, welds joining the main structural elements are so disposed to be stressed in shear rather than tension or compression; coextensive reinforcing members welded to said box along the diagonally and upwardly and outwardly extending portions of said tension member and the side plates; and separate stiffeners welded in a longitudinal array to the intermediate horizontal portion of the tension member.

* * * * *